US007641307B2

(12) United States Patent
Hsieh

(10) Patent No.: US 7,641,307 B2
(45) Date of Patent: Jan. 5, 2010

(54) MAINTENANCE DEVICE USED FOR CLEANING A PRINT HEAD OF AN INK CARTRIDGE

(75) Inventor: Yen-Sung Hsieh, Taipei (TW)

(73) Assignee: Qisda Corporation, Taoyuan County (TW)

( * ) Notice: Subject to any disclaimer, the term of this patent is extended or adjusted under 35 U.S.C. 154(b) by 569 days.

(21) Appl. No.: 11/558,418

(22) Filed: Nov. 9, 2006

(65) Prior Publication Data

US 2007/0109347 A1 May 17, 2007

(30) Foreign Application Priority Data

Nov. 11, 2005 (TW) ..... 94139769 A

(51) Int. Cl.
*B41J 2/165* (2006.01)

(52) U.S. Cl. ..... 347/33; 347/29; 347/32

(58) Field of Classification Search ..... 347/33, 347/29, 32
See application file for complete search history.

(56) References Cited

U.S. PATENT DOCUMENTS 5,896,145 A 4/1999 Osborne et al.
6,340,219 B1 * 1/2002 Kumagai et al. ..... 347/33
6,398,340 B1 * 6/2002 Lin ..... 347/33
6,497,473 B2 * 12/2002 Kim ..... 347/33
6,561,619 B1 5/2003 Shibata et al.

FOREIGN PATENT DOCUMENTS

| | | |
|---|---|---|
| JP | 6-255116 | 9/1994 |
| KR | 2001-0082815 A | 8/2001 |
| TW | I223627 | 11/2004 |
| TW | I240677 | 10/2005 |

* cited by examiner

*Primary Examiner*—Shih-Wen Hsieh

(57) ABSTRACT

A maintenance device used for cleaning a print head of an ink cartridge includes a housing including a stopper, and a wiper holder installed inside the housing in a rotatable manner. The wiper holder includes a gear. The maintenance device further includes a wiper fixed on the wiper holder, and a sled installed on the housing in a slidable manner. The sled includes a rack geared with the gear of the wiper holder for driving the wiper holder to rotate when a carrier of the ink cartridge pushes the sled. The maintenance device further includes a lock lever pivoted to the sled for wedging the stopper so as to fix the sled, and a first elastic component connected to the housing and the sled for pulling the sled when the lock lever departs from the stopper.

7 Claims, 11 Drawing Sheets

MAINTENANCE DEVICE USED FOR CLEANING A PRINT HEAD OF AN INK CARTRIDGE

BACKGROUND OF THE INVENTION

1. Field of the Invention

The present invention relates to a maintenance device used for cleaning a print head of an ink cartridge, and more particularly, to a maintenance device used for cleaning a print head of an ink cartridge with a wiper in a rotation method.

2. Description of the Prior Art

Copy machines, fax machines, and printers are commonly used for processing documents at work places. To meet the requirement of high printing quality, most inkjet printers have maintenance devices for print head cleaning and maintenance to avoid ink problems and ensure future printing precision. A wiper is installed on the maintenance device for scrubbing residual ink on the print head using relative movement between the wiper and the print head.

Please refer to FIG. 1 and FIG. 2. FIG. 1 and FIG. 2 are diagrams of a maintenance device 10 for an inkjet cartridge in different states in the prior art. The maintenance device 10 includes a wiper sliding platform 12 and a wiper base 14. The wiper sliding platform 10 has a wiper 16A and a wiper 16B for scrubbing ink from print heads. The wiper sliding platform 10 moves right with its sliding pins 18A and 18B sliding along the slits 20A and 20B inside the wiper base 14.

In state of FIG. 1 a carrier 24 drives cartridges 22A and 22B to the maintenance device 10. As the carrier 24 moves right, it contacts and pushes the wiper sliding platform 12 to move right, too. As state of FIG. 1 shows, the carrier 24 pushes the wiper sliding platform 12 right, along with the sliding pins 18A and 18B installed on the wiper sliding platform 12. The sliding pins 18A and 18B slide in the slits 20A and 20B respectively of the wiper base 14. As the sliding pins 18A and 18B slide right a distance S, the upward slopes of the slits 20A and 20B lift the sliding pins 18A and 18B and the wiper sliding platform 12 a fixed height. The wipers 16A and 16B installed on the wiper sliding platform 12 will then rise to a predetermined position so that the wipers 16A and 16B can contact the surfaces F of the cartridges 22A and 22B. The maintenance device 10 will keep the wipers 16A and 16B at the predetermined position while the carrier 24 drives the cartridges 22A and 22B backward, causing a moving contact between the wipers 16A, 16B and the surfaces F of the cartridges 22A, 22B to scrub ink from the print heads, thus cleaning the print heads.

The slopes of the slits 20A and 20B of the maintenance device 10 make the wiper sliding platform 10 lift from a height in state of FIG. 1 to a height in state of FIG. 2. Such slopes in the maintenance device 10 require an extra width for sliding to drive the wiper sliding platform 12 to a predetermined height. Therefore, an extra cost for an enlarged size of the maintenance device 10 exists, and possibilities for further miniaturization are reduced.

SUMMARY OF THE INVENTION

It is therefore a primary objective of the claimed invention to provide a maintenance device used for cleaning a print head of an ink cartridge with a wiper in a rotation method for solving the above-mentioned problem.

According to the claimed invention, a maintenance device used for cleaning a print head of an ink cartridge includes a housing including a stopper, and a wiper holder installed inside the housing in a rotatable manner. The wiper holder includes a gear. The maintenance device further includes a wiper fixed on the wiper holder, and a sled installed on the housing in a slidable manner. The sled includes a rack geared with the gear of the wiper holder for driving the wiper holder to rotate when a carrier of the ink cartridge pushes the sled. The maintenance device further includes a lock lever pivoted to the sled for wedging the stopper so as to fix the sled, and a first elastic component connected to the housing and the sled for pulling the sled when the lock lever departs from the stopper.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
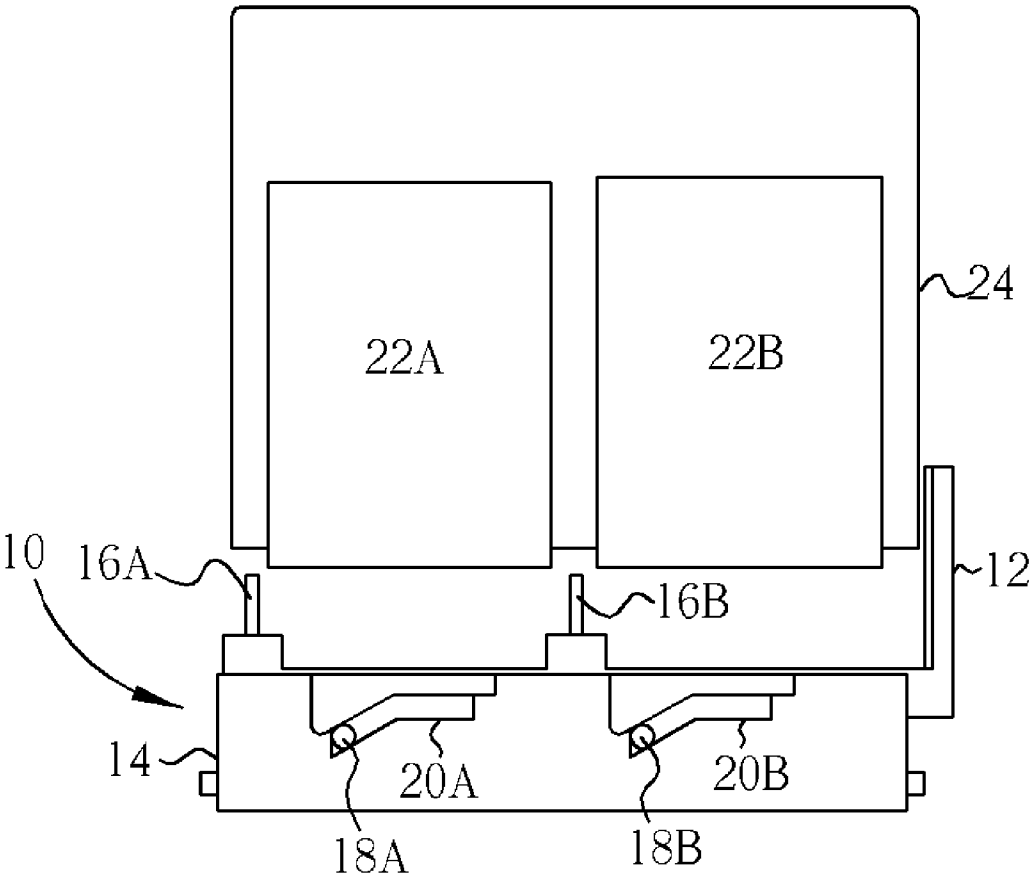
Fig. 1 Prior Art
FIG. 1 and FIG. 2 are diagrams of a maintenance device for an inkjet cartridge in different states in the prior art.
Figure 2:
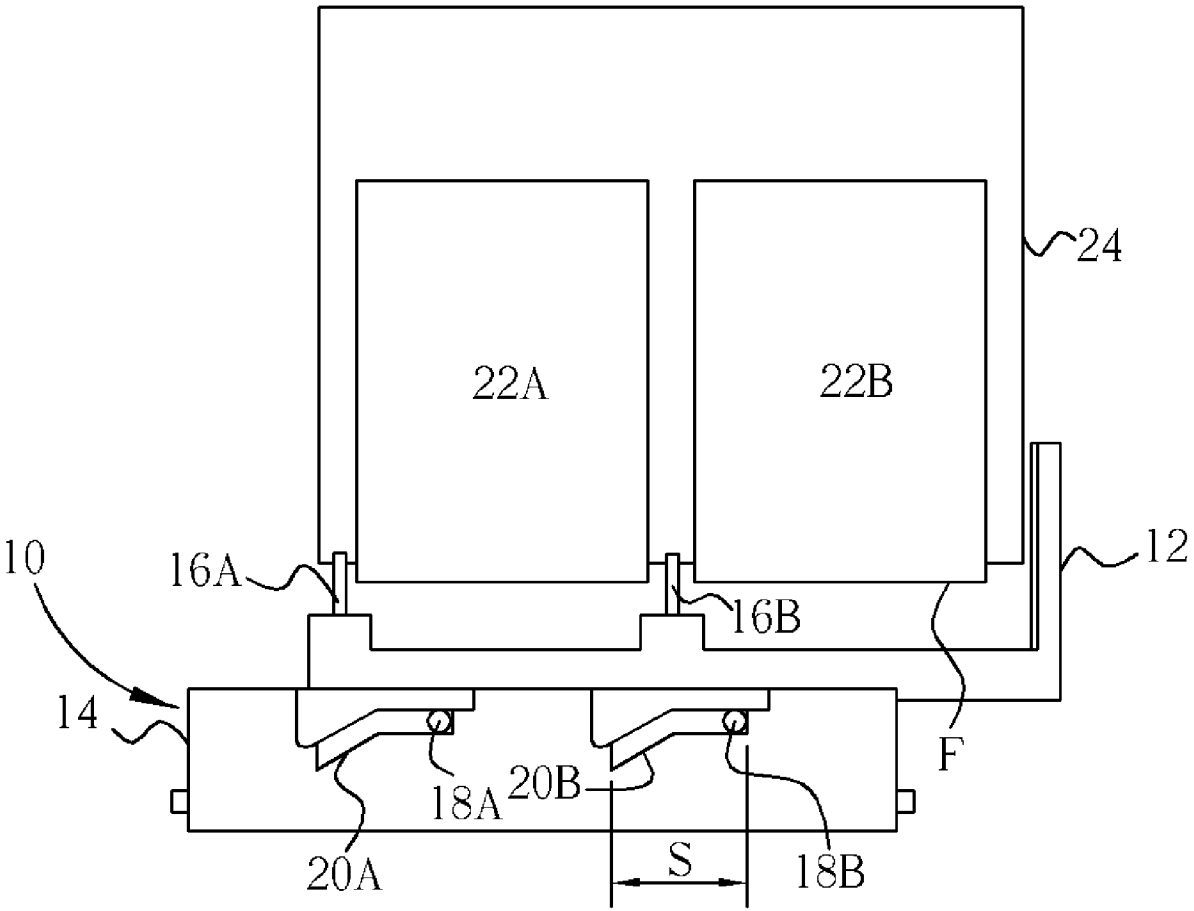
Fig. 2 Prior Art
Figure 3:
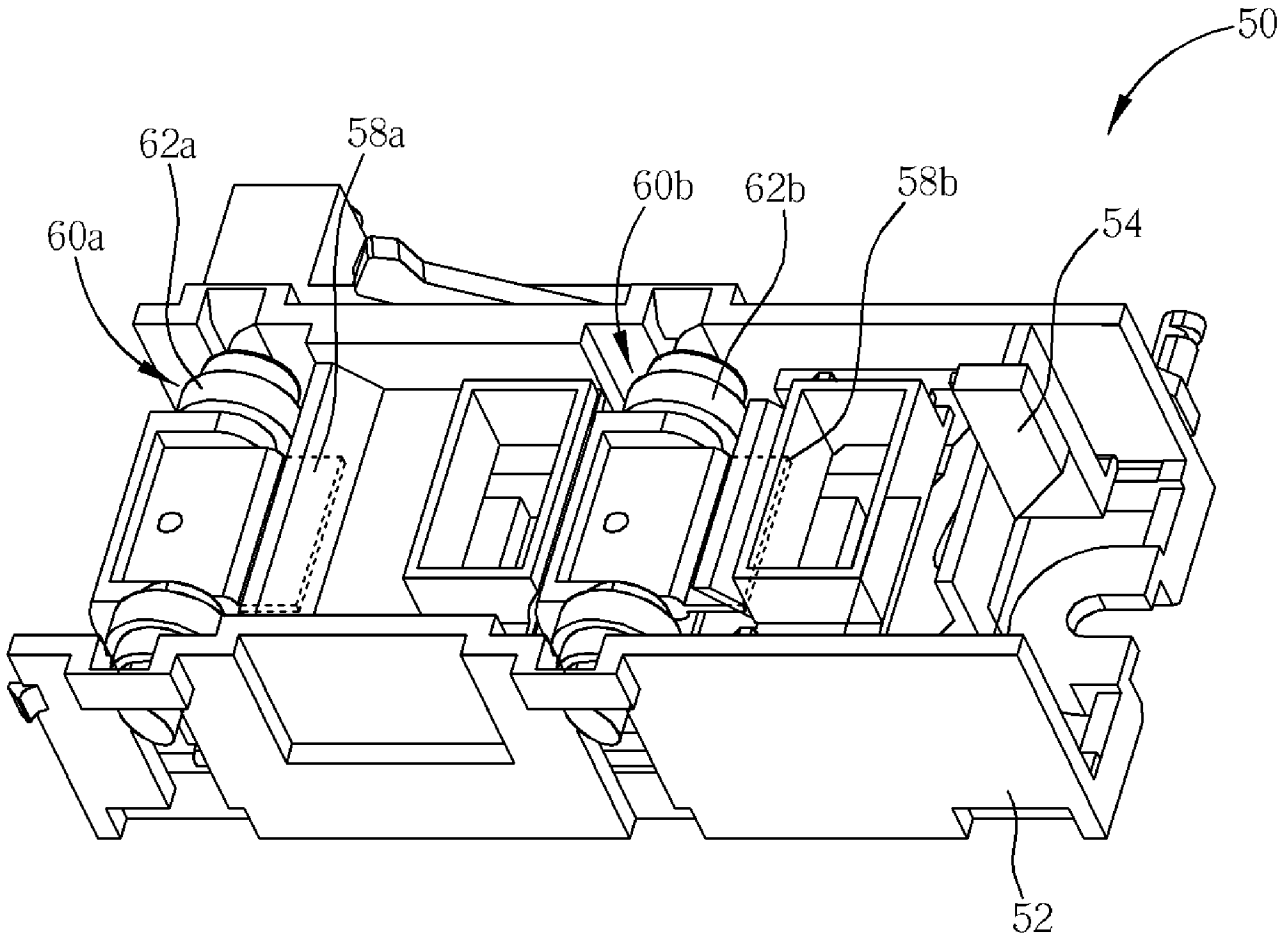
FIG. 3 is a perspective drawing of a maintenance device for an inkjet cartridge in a first state according to the present invention.
Figure 4:
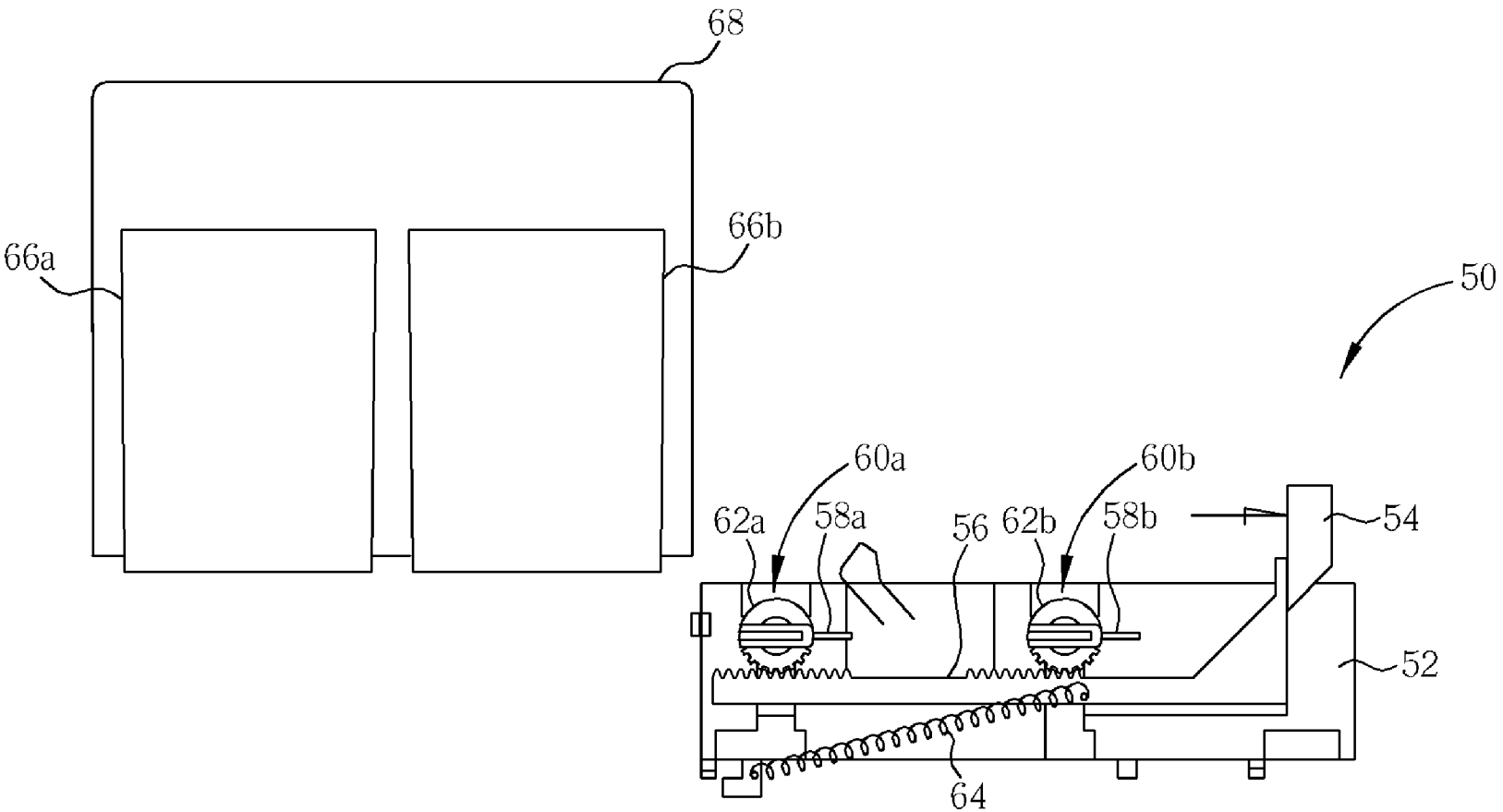
FIG. 4 is a diagram of inner structure of the maintenance device in the first state according to the present invention.

Please refer to FIG. 3 and FIG. 4. FIG. 3 is a perspective drawing of a maintenance device 50 for an inkjet cartridge in a first state according to the present invention. FIG. 4 is a diagram of inner structure of the maintenance device 50 in the first state according to the present invention. The maintenance device 50 includes a housing 52, and a sled 54 installed on the housing 52 in a slidable manner. The sled 54 includes a rack 56. The maintenance device 50 further includes a wiper 58*a* and a wiper 58*b* for scrubbing ink from print heads, and a wiper holder 60*a* and a wiper holder 60*b* installed inside the housing 52 in a rotatable manner. The wiper holder 60*a* and the wiper holder 60*b* can be pivoted to the housing 52. The wiper holder 60*a* and the wiper holder 60*b* include a gear 62*a* and a gear 62*b* respectively. The gear 62*a* and the gear 62*b* gear with the rack 56 on the sled 54 respectively. The rack 56 can drive the gear 62*a* and the gear 62*b* so as to drive the wiper 58*a* and the wiper 58*b* to rotate. The maintenance device 50 further includes a first elastic component 64 connected to the housing 52 and the sled 54. The first elastic component 64 can be a spring. In state of FIG. 3 and FIG. 4, a carrier 68 for carrying cartridges 66*a* and 66*b* does not move to contact the sled 54 on the maintenance device 50. The sled 54 is pulled by the first elastic component 64 in a static equilibrium, and the wiper 58*a* and the wiper 58*b* lie horizontally.

Figure 5:
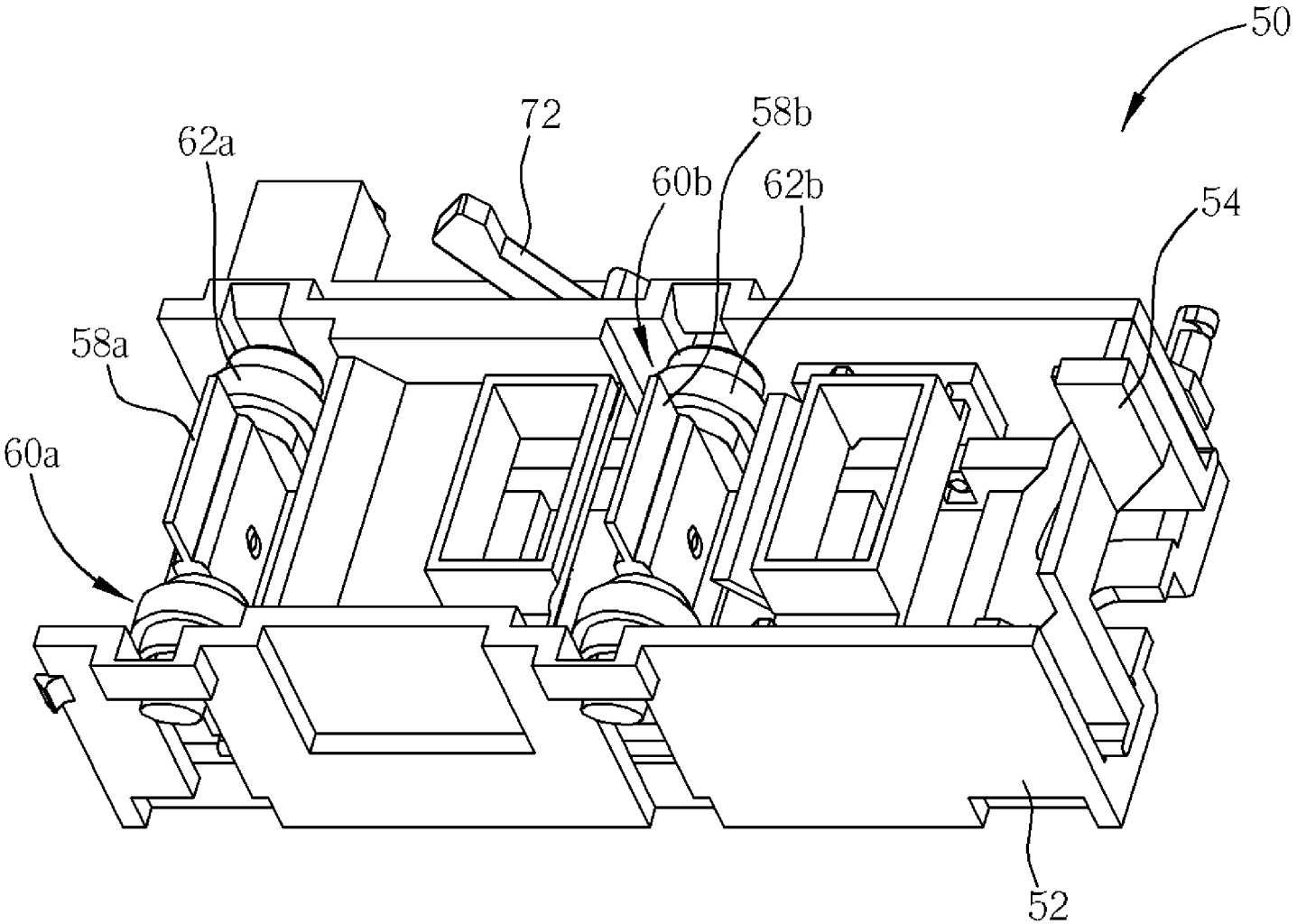
FIG. 5 is a perspective drawing of the maintenance device in a second state according to the present invention.
Figure 6:
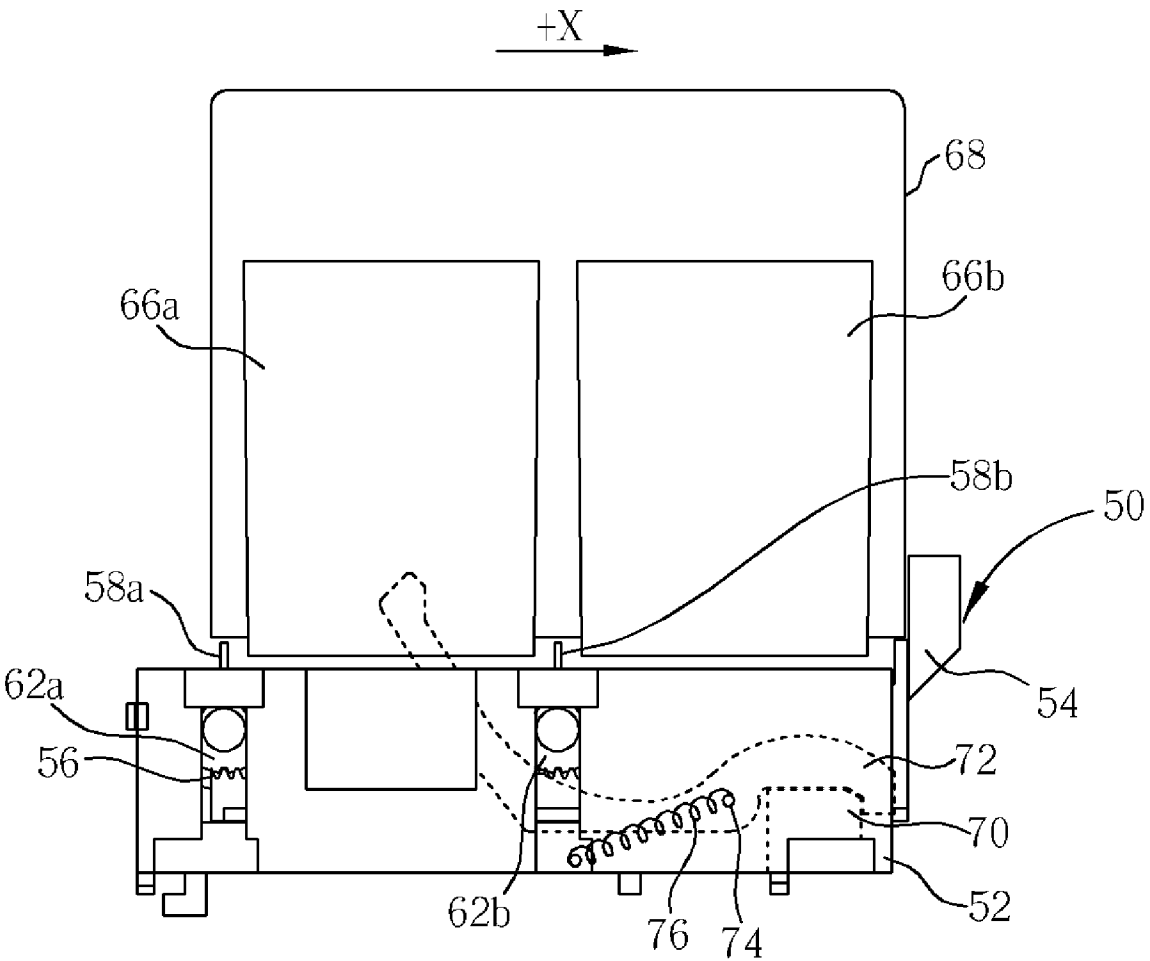
FIG. 6 is a diagram of inner structure of the maintenance device in the second state according to the present invention.

Please refer to FIG. 5 and FIG. 6. FIG. 5 is a perspective drawing of the maintenance device 50 in a second state according to the present invention. FIG. 6 is a diagram of inner structure of the maintenance device 50 in the second state according to the present invention. The housing 52 includes a stopper 70. The stopper 70 can be a protruding structure. The maintenance device 50 further includes a lock lever 72 pivoted to a hinge 74. An end of the lock lever 72 can be a hook for hooking the stopper 70 so as to fix the sled 54. The maintenance device 50 further includes a second elastic component 76 connected to the housing 52 and the lock lever 72 for pulling the lock lever 72 when the lock lever 72 departs from the stopper 70. The second elastic component 76 can be a spring. In state of FIG. 5 and FIG. 6, the carrier 68 for carrying the cartridges 66*a* and 66*b* moves to an initial position of print. When the carrier 68 moves in the +X direction for the maintenance device 50 to contact and push the sled 54, the rack 56 on the sled 54 drives the gear 62*a* and the gear 62*b* to rotate counterclockwise so that the wiper 58*a* and the wiper 58*b* rotate counterclockwise to vertical positions. The lock lever 72 rotates relative to the hinge 74 driven by the sled 54 and an elastic force provided by the second elastic component 76 so that the lock lever 72 locks the stopper 70 on the housing 52 for locking the wiper 58*a* and the wiper 58*b* when scrubbing ink from the print heads.

Figure 7:
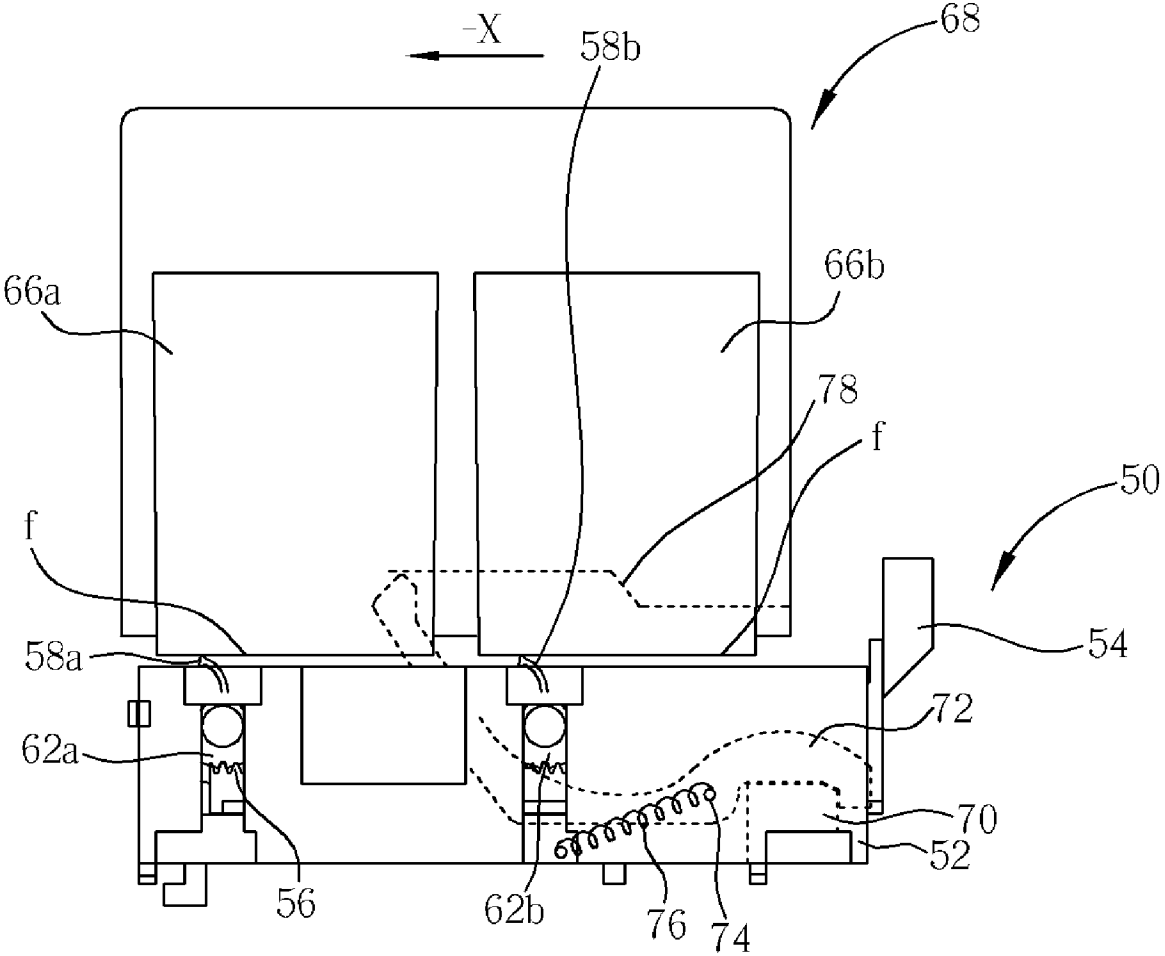
FIG. 7 is a diagram of inner structure of the maintenance device in a third state according to the present invention.
Figure 8:
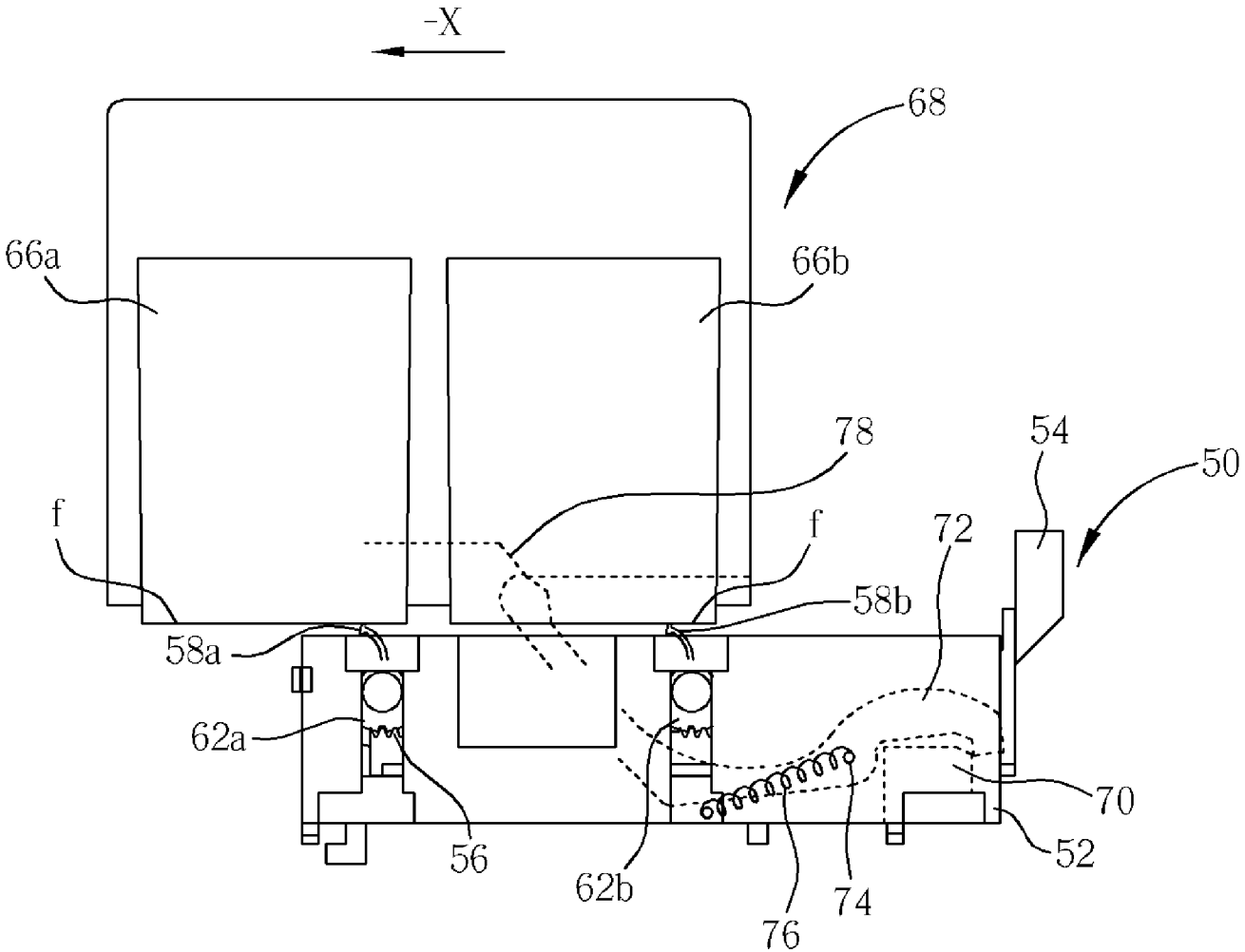
FIG. 8 is a diagram of inner structure of the maintenance device in a fourth state according to the present invention.

Please refer to FIG. 7 and FIG. 8. FIG. 7 is a diagram of inner structure of the maintenance device 50 in a third state according to the present invention. FIG. 8 is a diagram of inner structure of the maintenance device 50 in a fourth state according to the present invention. In the third state shown in FIG. 7, the carrier 68 for carrying the cartridges 66*a* and 66*b* moves from the initial position of print shown in FIG. 6 to the −X direction. The wipers 58*a* and 58*b* contact the surfaces F of the cartridges 66*a* and 66*b* to scrub ink from the print heads. The lock lever 72 locks the stopper 70 on the housing 52 so as to lock the wiper 58*a* and the wiper 58*b* when scrubbing ink from the print heads, and the sled 54 is fixed so that the wiper 58*a* and the wiper 58*b* keep in vertical positions. In addition, an incline 78 is positioned on the carrier 68. In the third state shown in FIG. 7, an end of the lock lever 72 can not hit the incline 78. In the fourth state shown in FIG. 8, the carrier 68 for carrying the cartridges 66*a* and 66*b* proceeds to move from the position in the third state shown in FIG. 7 to the −X direction until the end of the lock lever 72 hits the incline 78. The end of the lock lever 72 slides along the incline 78 for being pressed so that the lock lever 72 rotates relative to the hinge 74 and the other end of the lock lever 72 departs from the stopper 70 on the housing 52.

Figure 9:
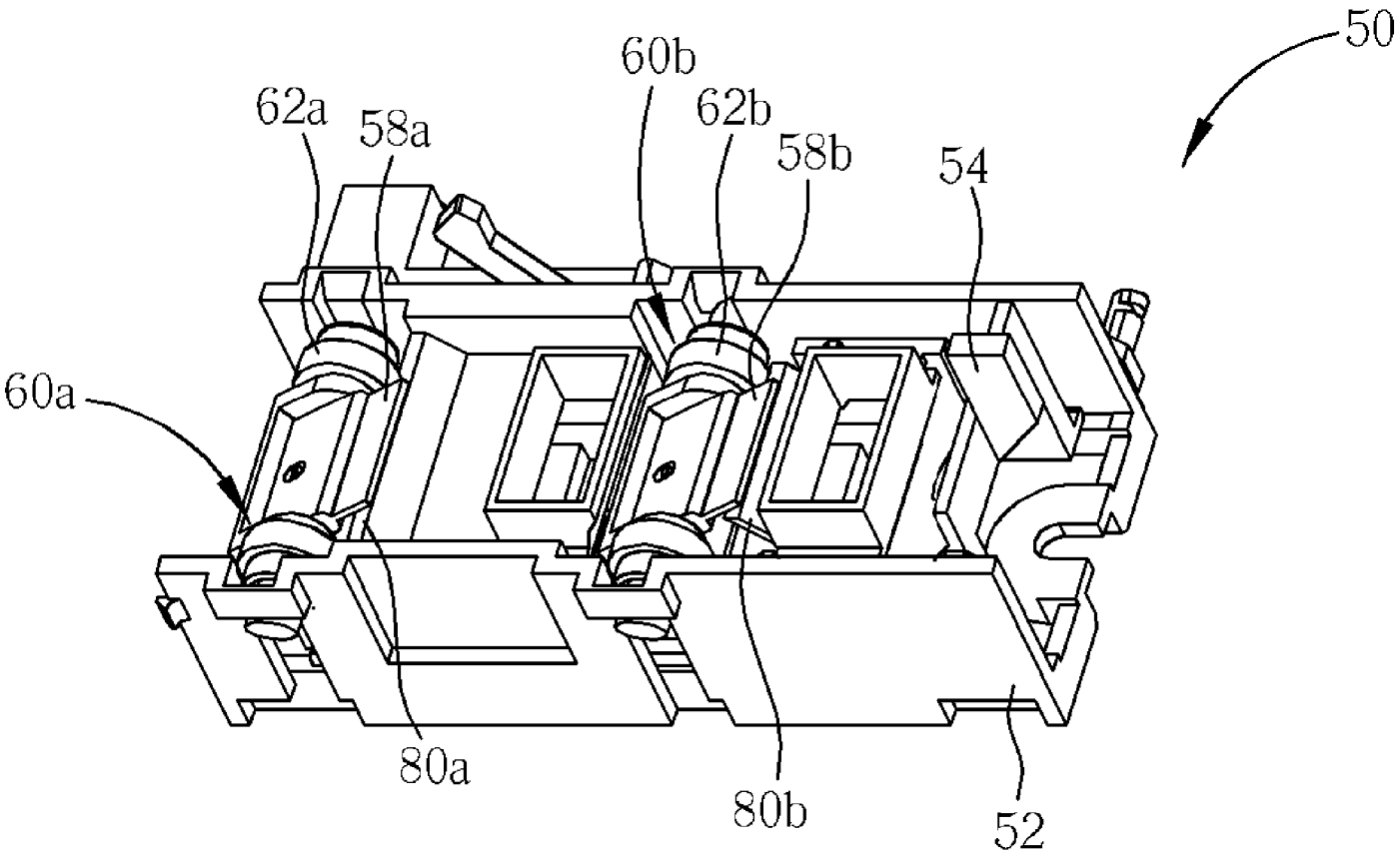
FIG. 9 is a perspective drawing of scrapers scraping ink on the wipers when the wipers rotate according to the present invention.
Figure 10:
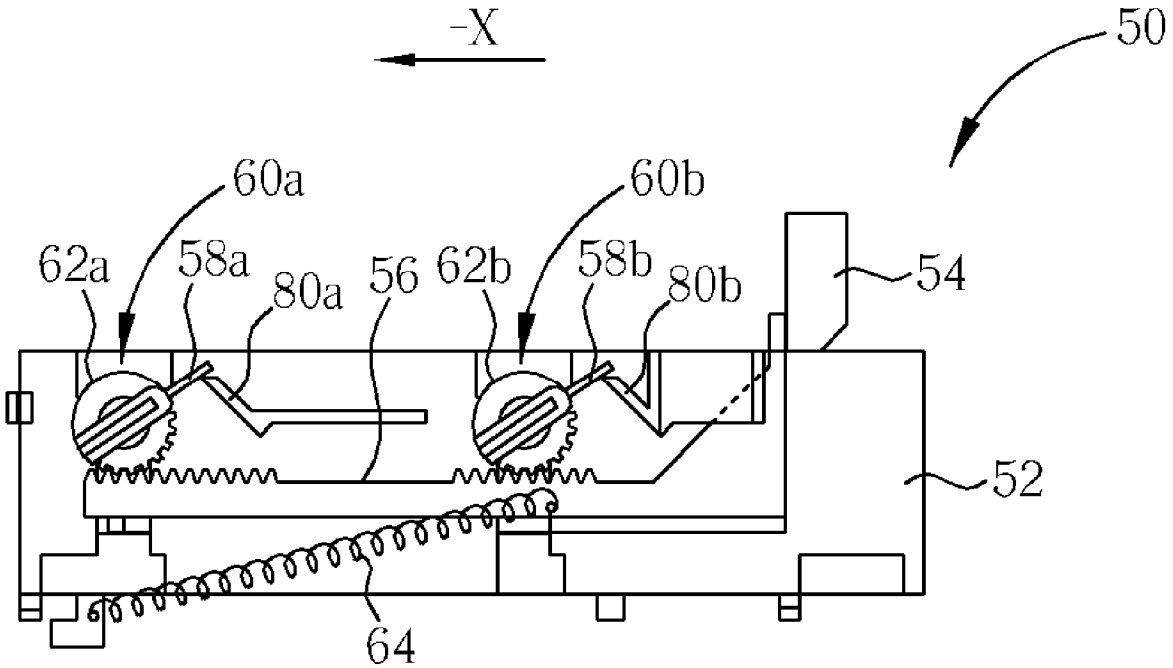
FIG. 10 is a diagram of the scrapers scraping ink on the wipers when the wipers rotate according to the present invention.

Please refer to FIG. 9 and FIG. 10. FIG. 9 is a perspective drawing of scrapers 80*a*, 80*b* scraping ink on the wipers 58*a*, 58*b* when the wipers 58*a*, 58*b* rotate according to the present invention. FIG. 10 is a diagram of the scrapers 80*a*, 80*b* scraping ink on the wipers 58*a*, 58*b* when the wipers 58*a*, 58*b* rotate according to the present invention. The maintenance device 50 further includes the scrapers 80*a*, 80*b* for scraping ink on the wipers 58*a*, 58*b* when the wipers 58*a*, 58*b* rotate. As shown in FIG. 8, when the end of the lock lever 72 departs from the stopper 70 on the housing 52, the sled 54 is pulled by an elastic force provided by the first elastic component 64 in the −X direction. The rack 56 drives the gears 62*a*, 62*b* to rotate clockwise for driving the wipers 58*a*, 58*b* to rotate toward the scrapers 80*a*, 80*b*. The scrapers 80*a*, 80*b* can scrape ink on the wipers 58*a*, 58*b* when the wipers 58*a*, 58*b* pass through the scrapers 80*a*, 80*b*.

Figure 11:
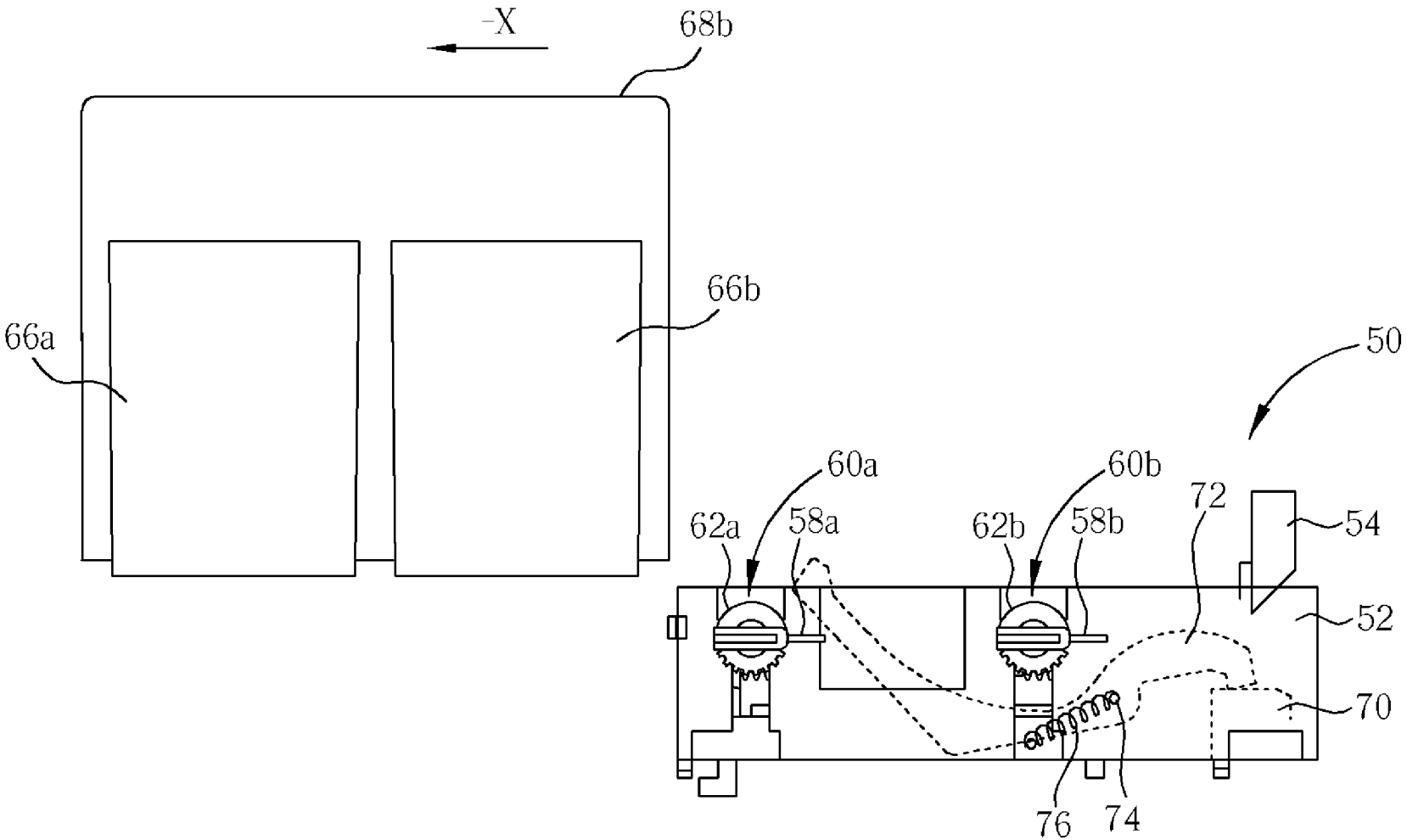
FIG. 11 is a diagram of an end of a lock lever departing from a stopper according to the present invention.

Please refer to FIG. 11 . FIG. 11 is a diagram of the end of the lock lever 72 departing from the stopper 70 according to the present invention. As shown in FIG. 8, after the end of the lock lever 72 departs from the stopper 70 on the housing 52, the lock lever 72 is pulled to an initial position as shown in FIG. 11 by an elastic force provided by the second elastic component 76. The maintenance device 50 will return to the first state shown in FIG. 3 and FIG. 4. The carrier 68 for carrying the cartridges 66*a* and 66*b* proceeds to move in the −X direction to a print area.

In conclusion, the maintenance device 50 according to the present invention cleans the print heads and the wipers 58*a*, 58*b* in a rotation method. When the print heads move to a predetermined position, the wipers 58*a*, 58*b* rotate from a horizontal state to a vertical state. The wipers 58*a*, 58*b* scrub residual ink on the print heads using relative movement between the wipers 58*a*, 58*b* and the print heads. At last the scrapers 80*a*, 80*b* scrape ink on the wipers 58*a*, 58*b* when the wipers 58*a*, 58*b* rotate.

In contrast to the conventional maintenance device used for cleaning a print head of an ink cartridge, the maintenance device according to the present invention cleans the print heads and the wipers in a rotation method. It can remove an extra distance that the wipers slide with the print heads. Therefore, an extra cost for an enlarged size of the maintenance device cuts down, and possibilities for further miniaturization are increased.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A maintenance device used for cleaning a print head of an ink cartridge comprising:

a housing including a stopper;

a wiper holder installed inside the housing in a rotatable manner, the wiper holder comprising a gear;

a wiper fixed on the wiper holder;

a sled installed on the housing in a slidable manner, the sled comprising a rack geared with the gear of the wiper holder for driving the wiper holder to rotate when a carrier of the ink cartridge pushes the sled;

a lock lever pivoted to the sled for wedging the stopper so as to fix the sled; and a first elastic component connected to the housing and the sled for pulling the sled when the lock lever departs from the stopper.

2. The maintenance device of claim 1 further comprising:

a second elastic component connected to the housing and the lock lever for pulling the lock lever when the lock lever departs from the stopper.

3. The maintenance device of claim 2 wherein the second elastic component is a spring.

4. The maintenance device of claim 1 further comprising a scraper for scraping ink on the wiper when the wiper rotates.

5. The maintenance device of claim 1 wherein the stopper is a protruding structure and an end of the lock lever is a hook for hooking the protruding structure.

6. The maintenance device of claim 1 wherein an incline is positioned on the carrier of the ink cartridge and the lock lever rotates relative to the sled so as to depart from the stopper when an end of the lock lever hits the incline.

7. The maintenance device of claim 1 wherein the first elastic component is a spring.

* * * * *

UNITED STATES PATENT AND TRADEMARK OFFICE

CERTIFICATE OF CORRECTION

PATENT NO. : 7,641,307 B2
APPLICATION NO. : 11/558418
DATED : January 5, 2010
INVENTOR(S) : Yen-Sung Hsieh It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 626 days.

Signed and Sealed this

Twenty-first Day of December, 2010

David J. Kappos

David J. Kappos
*Director of the United States Patent and Trademark Office*